US011859956B2

(12) United States Patent
Zemany et al.

(10) Patent No.: US 11,859,956 B2
(45) **Date of Patent: *Jan. 2, 2024**

(54) SYSTEM FOR CONTROLLING A PROJECTILE WITH MANEUVER ENVELOPES

(71) Applicant: BAE Systems Information and Electronic Systems Integration Inc., Nashua, NH (US)

(72) Inventors: Paul Zemany, Amherst, NH (US); Matthew Chrobak, Groton, MA (US)

(73) Assignee: BAE Systems Information and Electronic Systems Integration Inc., Nashua, NH (US)

( * ) Notice: Subject to any disclaimer, the term of this patent is extended or adjusted under 35 U.S.C. 154(b) by 379 days.

This patent is subject to a terminal disclaimer.

(21) Appl. No.: 17/263,955

(22) PCT Filed: Aug. 30, 2019

(86) PCT No.: PCT/US2019/048993
§ 371 (c)(1),
(2) Date: Jan. 28, 2021

(87) PCT Pub. No.: WO2020/112194
PCT Pub. Date: Jun. 4, 2020

(65) Prior Publication Data

US 2021/0231424 A1 Jul. 29, 2021

Related U.S. Application Data

(60) Provisional application No. 62/725,491, filed on Aug. 31, 2018.

(51) Int. Cl.

| | |
|---|---|
| ***F42B 15/01*** | (2006.01) |
| ***F42B 10/14*** | (2006.01) |
| ***F42B 10/64*** | (2006.01) |

(52) U.S. Cl.
CPC ..... *F42B 15/01* (2013.01); *F42B 10/14* (2013.01); *F42B 10/64* (2013.01)

(58) Field of Classification Search
CPC ..... F42B 15/01; F42B 10/14; F42B 10/64
See application file for complete search history.

(56) References Cited

U.S. PATENT DOCUMENTS

| | | | |
|---|---|---|---|
| 6,614,012 B2 | 9/2003 | Schneider et al. | |
| 7,350,744 B1 * | 4/2008 | Schwartz | F42B 15/01 244/3.1 |

(Continued)

OTHER PUBLICATIONS

1. Fresconi, "Guidance and Control of a Fin Stabilized Projectile based on Flight Dynamics with Reduced Sensor and Actuator Requirements", Army Research Laboratory, published Feb. 2011. (Year: 2011).*

(Continued)

*Primary Examiner* — Marcus E Windrich
(74) *Attorney, Agent, or Firm* — Scott J. Asmus; Gary McFaline; Sand, Sebolt & Wernow LPA

(57) ABSTRACT

A guided projectile including a precision guidance munition assembly utilizes at least one maneuver envelope to optimally control movement of at least one canard to steer the guided projectile during flight. The maneuver envelopes optimize movements of the at least one canard that effectuate movement in either the range direction or the cross-range direction, or both. The maneuver envelope enables optimal timing such that maneuvering in one direction does not come at the expense of maneuver authority in the other direction.

17 Claims, 10 Drawing Sheets

(56) References Cited

U.S. PATENT DOCUMENTS

| | | | | |
|---|---|---|---|---|
| 8,190,305 | B1 * | 5/2012 | Prince | F42B 15/01 244/175 |
| 9,366,514 | B1 | 6/2016 | Barnard et al. | |
| 11,342,687 | B1 * | 5/2022 | Rossman | H01Q 21/067 |
| 2004/0188561 | A1 | 9/2004 | Ratkovic et al. | |
| 2005/0040280 | A1 * | 2/2005 | Hua | G05D 1/107 701/3 |
| 2007/0241227 | A1 * | 10/2007 | Zemany | F41G 7/2293 244/3.1 |
| 2012/0138729 | A1 * | 6/2012 | Hindman | G05D 1/0066 244/76 R |
| 2012/0248237 | A1 * | 10/2012 | Dolphin | F42B 15/01 244/3.15 |
| 2016/0320165 | A1 | 11/2016 | Rovinsky | |
| 2021/0310776 | A1 * | 10/2021 | Selz | G01S 5/14 |

OTHER PUBLICATIONS

Fresconi. "Guidance and Control of a Fin-Stabilized Projectile Based on Flight Dynamics with Reduced Sensor and Actuator Requirements." In: AIAA Guidance, Navigation, and Control Conference; Aug. 8, 2011-Aug. 11, 2011, [online] [retrieved on Apr. 20, 2020] Retrieved from the Internet< URL: https://doi.org/10.2514/6.2011-6248 >, entire document, especially p. 1; 2; 4; 6-9; 12; 13; 14; Figs 5-6b.

T. Mairson, J. Smith, & K. Smith, Champ phase II: Exploratory development; vol. II: Theory and simulation of controlled projectile, Technical Report AD-A145, Feb. 1997, 160, Army ARRADCOM, Dover, NJ.

F. Regan & J. Smith, Aeroballistics of a terminally corrected spinning projectile (tcsp), Journal of Spacecraft, Dec. 1975, pp. 733-738, vol. 12, No. 12.

International Search Report, PCT/US19/48993, dated May 19, 2020, 10 pages.

International Search Report, PCT/US19/49013, dated Nov. 15, 2019, 7 pages.

* cited by examiner

SYSTEM FOR CONTROLLING A PROJECTILE WITH MANEUVER ENVELOPES

CROSS REFERENCE TO RELATED APPLICATIONS

This application claims the benefit of U.S. Provisional Patent Application No. 62/725,491, filed Aug. 31, 2018, the content of which is incorporated by reference herein its entirety.

TECHNICAL FIELD

The present disclosure relates generally to a system and method of controlling a projectile. The system and method in one example utilizes a maneuver envelope that identifies maneuver or control authority of the projectile in order to implement corrective maneuvers to effect range and cross-range movements of the projectile relative to a target.

BACKGROUND

Guided projectiles are typically limited in how much they can maneuver. Thus, the maneuver authority of a guided projectile is an important component in launching the guided projectile. The maneuver authority depends on a plurality of factors and there is a complex relationship between change of ground impact points and control actions. One factor is the quadrant elevation of a launch assembly, such as a barrel or gun tube, that fires the projectile. However, simply accounting for the quadrant elevation and performing some corrective maneuver to effect changes in the range or cross-range may come at the expense of the other. For example, correcting the cross-range at a first time may be detrimental to the range control authority than if correcting the cross-range at a different second time. Further, generation of control commands is complex due to control reversals, range/cross range coupling, and significant variation of control versus time in flight. In order to maximize maneuver footprint, a detailed understanding of the complex relationship between ground impact points and projectile control actions is needed.

SUMMARY

Issues continue to exist with optimizing when to perform a corrective maneuver for a projectile. Steering the projectile to compensate or correct one of the range and cross-range directions may come at the expense of the maneuver or control authority of the other. During the flight of the projectile, the effect of a given control command on the impact point is highly variable. The present disclosure addresses these issues by optimizing control of the projectile through the use of maneuver envelopes that describe the effect of control actions versus time and are used to determine when to effectuate corrective maneuvers on an optimal fashion. Thus, for example, a maneuver envelope may describe how to make a cross-range correction without much expense to the projectile control in an orthogonal direction. The projectile guidance munition assembly may utilize results of the maneuver envelopes to correct for larger impact errors by facilitating more efficient use of the limited control authority.

In one aspect, an exemplary embodiment of the present disclosure may provide a precision guidance munition assembly for a guided projectile, comprising: a canard assembly including at least one canard that is moveable, and at least one non-transitory computer-readable storage medium carried by the precision guidance munition assembly having instructions encoded thereon that when executed by at least one processor operates to aid in guidance, navigation and control of the guided projectile. The encoded instructions include: select a maneuver envelope that describes a control authority of the guided projectile, predict an impact point of the guided projectile relative to a target; determine a miss distance error based on the predicted impact point relative to the target; determine a maneuver command based on the maneuver envelope; and apply the maneuver command to move the at least one canard on the canard assembly at an optimal time based, at least in part, on the maneuver envelope.

In one example, the selected maneuver envelope may be based, at least in part, on a launch velocity and a quadrant elevation of the guided projectile.

In one example, a plurality of maneuver envelopes may be stored in the at least one non-transitory computer-readable storage medium and the selected maneuver envelope may be selected from the plurality of maneuver envelopes. In another example, the selected maneuver envelope may be predetermined and uploaded to the at least one non-transitory computer-readable storage medium prior to firing the guided projectile.

In one example, the maneuver envelope may include tabulated digital information of the maneuver envelope identifying an amount of ground maneuver per second as a function of time and a roll angle of the precision guidance munition assembly.

In one example, the precision guidance munition assembly may include a maximum canard deflection and a roll angle phi and the ground maneuver per second as a function of time may be based, at least in part, on the roll angle phi and the maximum canard deflection.

In one example, the instructions may further include selecting the roll angle phi from a specific time interval of the maneuver envelope to reduce the miss distance error.

In one example, the maneuver envelope may specify a range control reversal specified by the maneuver envelope. In this example, when the maneuver command is applied at one time interval the range increases and when the maneuver command is applied at another different time interval the range decreases.

In one example, the roll angle phi for a specified direction on the ground varies when the maneuver command is applied at different time intervals.

The precision guidance munition assembly may further include a timer in operative communication with the at least one processor and a plurality of command rings of the maneuver envelope at different time intervals of a flight of the guided projectile that indicate range maneuverability and cross-range maneuverability of the guided projectile within each of the different time intervals. The command rings may be predetermined and uploaded to the at least one non-transitory computer-readable storage medium prior to firing the guided projectile. The command rings may be determined through a modeling function accounting for launch velocity and quadrant elevation of the guided projectile.

The precision guidance munition assembly may further include canard logic that moves the at least one canard in response to a signal from the at least one processor associated with the maneuver envelope.

In one example, the instructions may further include producing a dot product for a match ratio versus time and evaluating whether the selected maneuver command is effective. In one example, the selected maneuver command is effective if the match ratio versus time is greater than or equal to approximately 0.85.

In another aspect, an exemplary embodiment of the present disclosure may provide a method comprising selecting a maneuver envelope that describes a control authority of the guided projectile, predicting an impact point of the guided projectile relative to a target, determining a miss distance error based on the predicted impact point relative to the target, determining a maneuver command based on the maneuver envelope, and optimally applying the maneuver command to move the at least one canard on the canard assembly at an optimal time based, at least in part, on the maneuver envelope.

In another aspect, an exemplary embodiment of the present disclosure may provide a guided projectile including a precision guidance munition assembly utilizes a maneuver envelope to optimally control movement of at least one canard to steer the guided projectile during flight. The maneuver envelopes optimize movements of the at least one canard that effectuate movement in either the range direction or the cross-range direction, or both. The maneuver envelope enables optimal timing such that maneuvering in one direction does not come at the expense of maneuver authority in the other direction.

BRIEF DESCRIPTION OF THE SEVERAL VIEWS OF THE DRAWINGS

Sample embodiments of the present disclosure are set forth in the following description, is shown in the drawings, and is particularly and distinctly pointed out and set forth in the appended claims.

Similar numbers refer to similar parts throughout the drawings.

DETAILED DESCRIPTION

Figure 1:
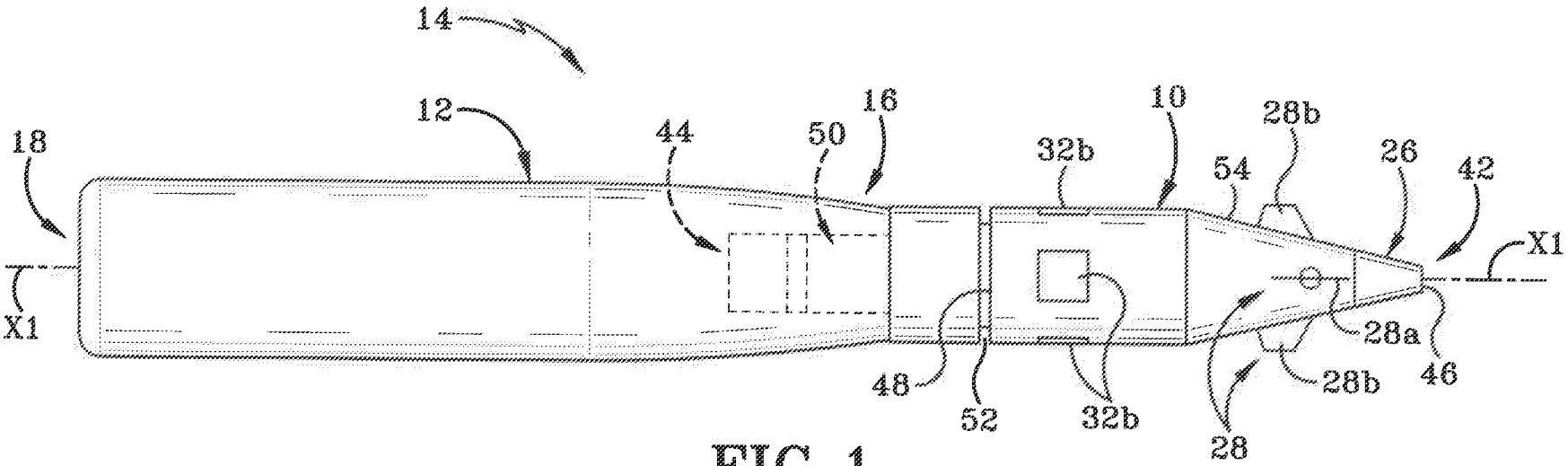
FIG. 1 is a schematic view of a guided projectile including a munition body and a precision guidance munition assembly in accordance with one aspect of the present disclosure.

A precision guidance munition assembly (PGMA), also referred to as a precision guidance kit, (PGK) in the art, in accordance with the present disclosure is shown generally at 10. As shown in FIG. 1, the PGMA 10 is operatively coupled with a munition body 12, which may also be referred to as a projectile, to create a guided projectile 14. In one example, the PGMA 10 is coupled to the munition body 12 via a threaded connection; however, the PGMA 10 may be coupled to the munition body 12 in any suitable manner. In one example, such as the APWKS precision guided kit, the PGMA is coupled between the munition body and front end assembly thereby turning a projectile into a precision guided projectile.

Figure 3:
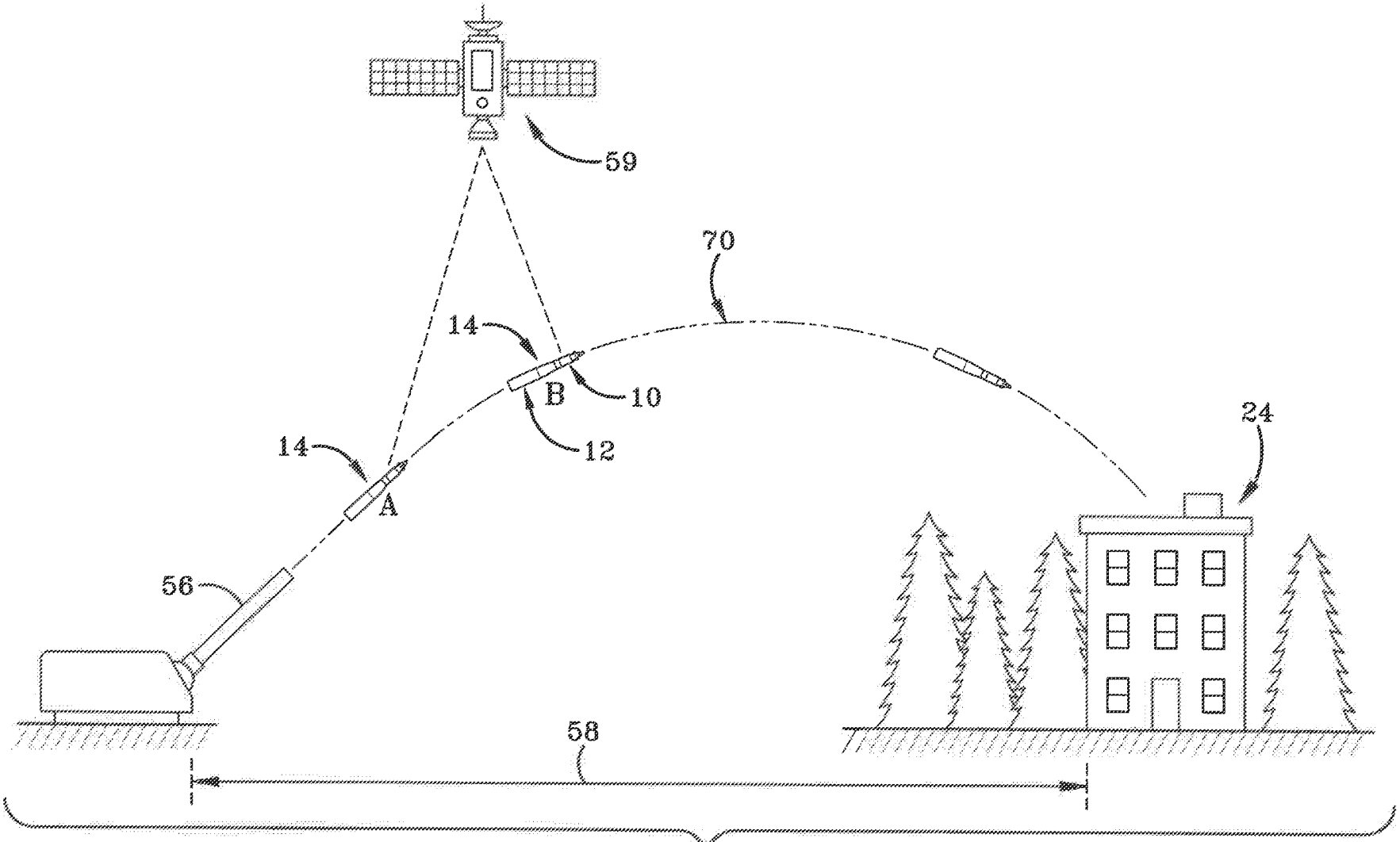
FIG. 3 is an operational schematic view of the guided projectile including the munition body and the precision guidance munition assembly fired from a launch assembly according to one embodiment.

FIG. 1 depicts that the munition body 12 includes a front end 16 and an opposite tail or rear end 18 defining a longitudinal direction therebetween. The munition body 12 includes a first annular edge 20 (FIG. 1A), which, in one particular embodiment, is a leading edge on the munition body 12 such that the first annular edge 20 is a leading annular edge that is positioned at the front end 16 of the munition body 12. The munition body 12 defines a cylindrical cavity 22 (FIG. 1A) extending rearward from the first annular edge 20 longitudinally centrally along a center of the munition body 12. The munition body 12 is formed from material, such as metal, that is structurally sufficient to carry an explosive charge configured to detonate or explode at, or near, a target 24 (FIG. 3). The munition body 12 may include tail fins (not shown) which help stabilize the munition body 12 during flight.

Figure 1A:
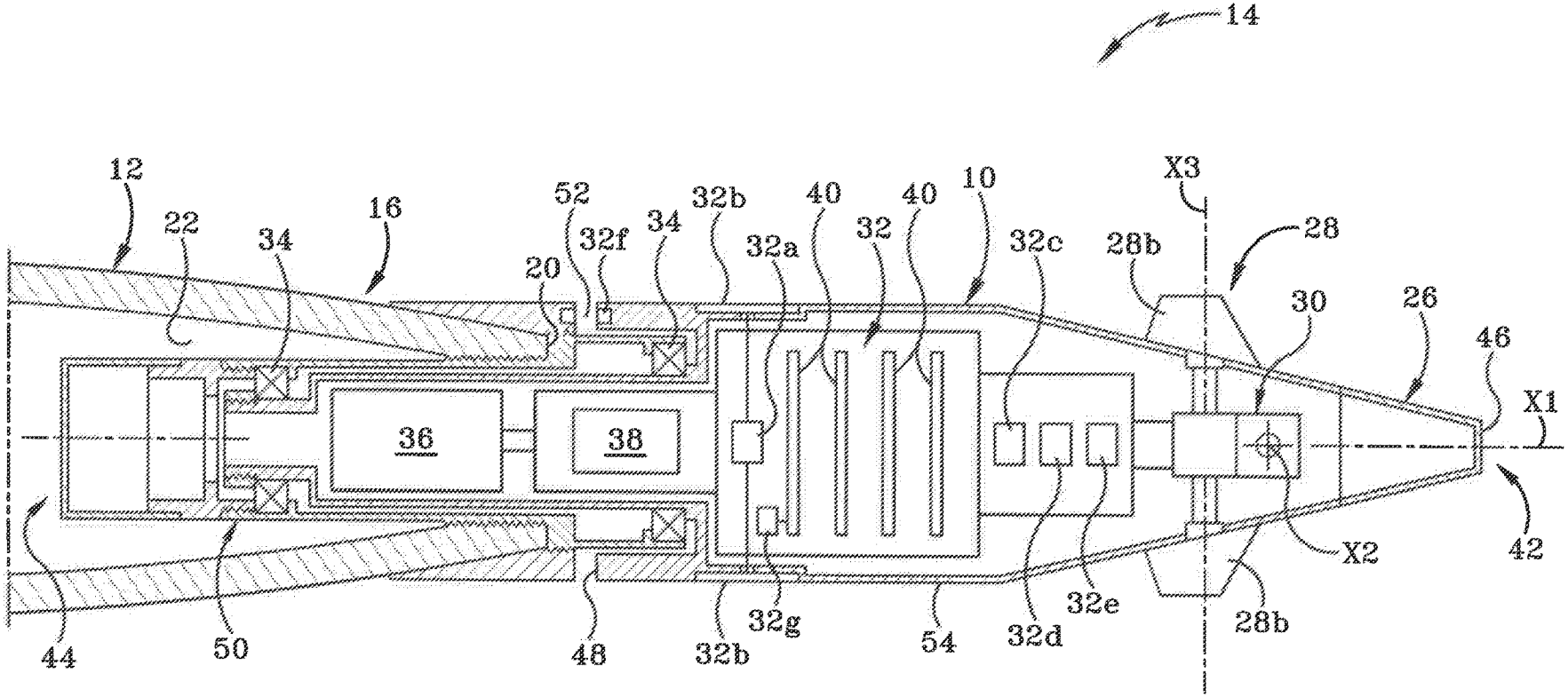
FIG. 1A is an enlarged fragmentary cross-section view of the guided projectile including the munition body and the precision guidance munition assembly in accordance with one aspect of the present disclosure.

FIG. 1A depicts that the PGMA 10, which may also be referred to as a despun assembly, includes, in one example, a fuze setter 26, a canard assembly 28 having one or more canards 28*a*, 28*b*, a control actuation system (CAS) 30, a guidance, navigation and control (GNC) section 32 having at least one guiding sensor 32*a*, such as a global positioning system (GPS), at least one antenna 32*b*, a magnetometer 32*c*, a microelectromechanical systems (MEMS) gyroscope 32*d*, an MEMS accelerometer 32*e*, and a rotation sensor 32*f*, at least one bearing 34, a battery 36, at least one non-transitory computer-readable storage medium 38, and at least one processor or microprocessor 40.

Although the GNC section 32 has been described in FIG. 1A as having particular sensors, it should be noted that in other examples the GNC section 32 may include other sensors, including, but not limited to, laser guided sensors, electro-optical sensors, imaging sensors, inertial navigation systems (INS), inertial measurement units (IMU), timing sensors, or any other suitable sensors. In one example, the GNC section 32 may include an electro-optical and/or imaging sensor positioned on a forward portion of the PGMA 10. In another example, there may be multiple sensors employed such that the guided projectile 14 can operate in a GPS-denied environment and for highly accurate targeting. The projectile, in one example, has multiple sensors and switches from one sensor to another during flight. For example, the projectile can employ GPS while it is available but then switch to another sensor for greater accuracy or if the GPS signal is unreliable or no longer available. For example, it may switch to an imaging sensor to hone in to a precise target.

The at least one computer-readable storage medium 38 includes instructions encoded thereon that when executed by the at least one processor 40 carried by the PGMA 10 implements operations to aid in guidance, navigation and control (GNC) of the guided projectile 14.

The PGMA 10 includes a nose or front end 42 and an opposite tail or rear end 44. When the PGMA 10 is coupled to the munition body 12, a longitudinal axis X1 extends centrally from the rear end 18 of the munition body to the front end 42 of the PGMA 10. FIG. 1A depicts one embodiment of the PGMA 10 as generally cone-shaped and defines the nose 42 of the PGMA 10. The one or more canards 28*a*, 28*b* of the canard assembly 28 are controlled via the CAS 30. The PGMA 10 further includes a forward tip 46 and a second annular edge 48. In one embodiment, the second annular edge 48 is a trailing annular edge 48 positioned rearward from the tip 46. The second annular edge 48 is oriented centrally around the longitudinal axis X1. The second annular edge 48 on the canard PGMA 10 is positioned forwardly from the first edge 20 on the munition body 12. The PGMA 10 further includes a central cylindrical extension 50 that extends rearward and is received within the cylindrical cavity 22 via a threaded connection.

The second annular edge 48 is shaped and sized complementary to the first annular edge 20. In one particular embodiment, a gap 52 is defined between the annular edge 48 and the leading edge 20. The gap 52 may be an annular gap surrounding the extension 50 that is void and free of any objects so as to effectuate the free rotation of the PGMA 10 relative to the munition body 12.

Figure 2:
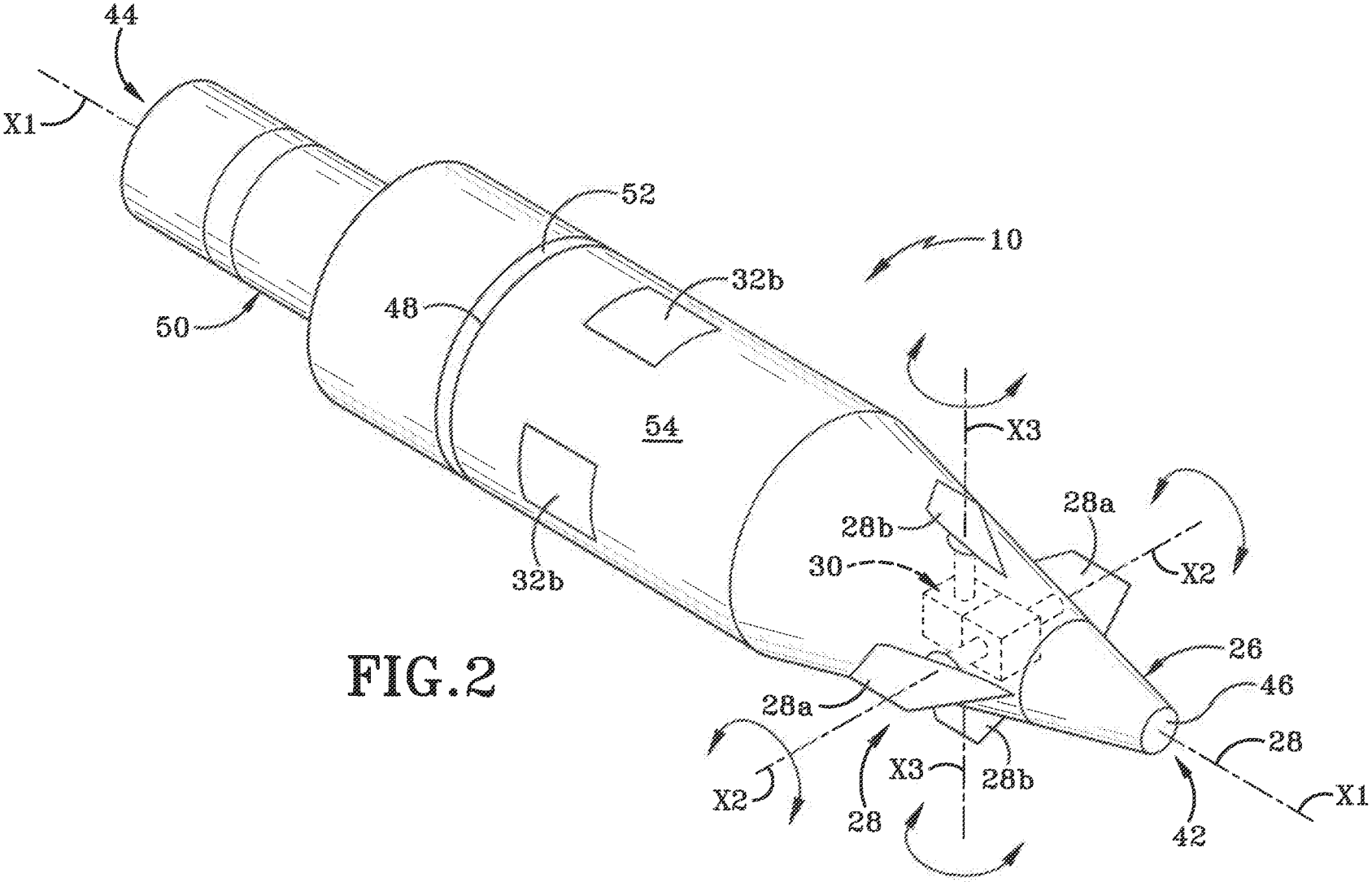
FIG. 2 is a schematic perspective view of the precision guidance munition assembly according to one embodiment.

FIG. 2 depicts an embodiment of the precision guidance munition assembly, wherein the PGMA 10 includes at least one lift canard 28*a* extending radially outward from an exterior surface 54 relative to the longitudinal axis X1. The at least one lift canard 28*a* is pivotably connected to a portion of the PGMA 10 via the CAS 30 such that the lift canard 28*a* pivots relative to the exterior surface 54 of the PGMA 10 about a pivot axis X2. In one particular embodiment, the pivot axis X2 of the lift canard 28*a* intersects the longitudinal axis X1. In one particular embodiment, a second lift canard 28*a* is located diametrically opposite the at least one lift canard 28*a*, which could also be referred to as a first lift canard 28*a*. The second lift canard 28*a* is structurally similar to the first lift canard 28*a* such that it pivots about the pivot axis X2. The PGMA 10 can control the pivoting movement of each lift canard 28*a* via the CAS 30. The first and second lift canards 28*a* cooperate to control the lift of the guided projectile 14 while it is in motion after being fired from a launch assembly 56 (FIG. 3).

The PGMA 10 may further include at least one roll canard 28*b* extending radially outward from the exterior surface 54 relative to the longitudinal axis X1. In one example, the at least one roll canard 28*b* is pivotably connected to a portion of the PGMA 10 via the CAS 30 such that the roll canard 28*b* pivots relative to the exterior surface 54 of the PGMA 10 about a pivot axis X3. In one particular embodiment, the pivot axis X3 of the roll canard 28*b* intersects the longitudinal axis X1. In one particular embodiment, a second roll canard 28*b* is located diametrically opposite the at least one roll canard 28*b*, which could also be referred to as a first roll canard 28*b*. The second roll canard 28*b* is structurally similar to the first roll canard 28*b* such that it pivots about the pivot axis X3. The PGMA 10 can control the pivoting movement of each roll canard 28*b* via the CAS 30. The first and second roll canards 28*b* cooperate to control the roll of the guided projectile 14 while it is in motion after being fired from the launch assembly 56 (FIG. 3). While the launch assembly 56 is shown as a ground vehicle in this example, the launch assembly may also be on vehicles that are air-borne assets or maritime assets. The air-borne assets, for example, includes planes, helicopters and drones.

The canards 28*a*, 28*b* on the canard assembly 28 are moveable in order to guide or direct the guided projectile 14 during its flight in order to steer the guided projectile 14 relative to the target 24 on the ground. Due to the complex dynamics of the flight of the guided projectile 14, moving the at least one canard 28*a*, 28*b*, causes the impact point of the guided projectile 14 to move in different directions and different distances relative to the target 24 depending on the time of flight of the guided projectile 14. Thus, movement of the at least one canard 28*a*, 28*b*, in one direction at a first time will result in a movement of the impact point of the guided projectile 14 relative to the target 24 and movement of the at least one canard 28*a*, 28*b*, in the same direction at a later second time will result in a different movement of the impact point of the guided projectile 14 relative to the target 24 (i.e., the impact point of the guided projectile 14 could move in a different direction and a different distance relative to the target 24). To properly and optimally account for this complex behavior, the guided projectile 14 utilizes maneuver envelopes 32*g* to optimally determine the canard commands to guide the guided projectile 14 to the target 24.

FIG. 3 depicts the operation of the PGMA 10 when it is coupled to the munition body 12 forming the guided projectile 14. As shown in FIG. 3, the guided projectile 14 is fired from the launch assembly 56 elevated at a quadrant elevation towards the target 24 located at an estimated or nominal distance 58 from the launch assembly 56. Guided projectiles 14 are typically limited in how much they can maneuver. Thus, the maneuver authority of the guided projectile 14 is a factor in launching the guided projectile 14. The present disclosure provides a system and device to optimize the maneuvering of the guided projectile 14 based on its maneuver authority as determined by one of a plurality of maneuver envelopes 32*g* stored in the memory 38. Once the maneuver authority of the guided projectile 14 is known, a correction can be made by deflecting one or more of the canards 28*a*, 28*b*, to precisely guide the guided projectile 14 towards its intended target 24.

When the guided projectile 14 is launched from the launch assembly 56 or gun tube, the amount that the canards 28*a*, 28*b*, can move to steer the guided projectile 14 is based, at least in part, on the maneuver authority. The maneuver authority is a function of time of flight, launch speed and quadrant elevation. The maneuver envelopes account for the maneuver authority at each respective time interval to optimize steering commands that drive the canards 28*a*, 28*b* in order to guide the guided projectile 14 towards the intended target 24.

The guided projectile 14 employs one or more guiding sensors to assist in guiding the projectile to the target. In one example, the GNC section 32 employs GPS which uses satellites 59 that can provide precision data such as location, timing, speed and the like.

The guided projectile 14 performs a corrective maneuver by adjusting one or more canards 28*a*, 28*b*, to adjust the predicted impact range or cross-range as needed to guide the guided projectile 14 towards the target 24. In accordance with one aspect of the present disclosure, the range or cross-range correction maneuver (or both) begins early in flight of the guided projectile 14.

In one example, a maneuver envelope 32*g* is generated for each quadrant elevation and launch velocity in which the launch assembly 56 may be positioned in order to fire the guided projectile 14. For example, and not meant as a limitation, the maneuver envelopes 32*g* may be generated by an offline computer for any set of launch conditions, including, but not limited to, different launch speeds and quadrant elevations. The maneuver envelopes 32*g* may then be stored in or uploaded to the PGMA 10 or a single maneuver envelope 32*g* representing a particular planned launch condition can be loaded into the guided projectile 14 prior to launch.

Each one of the maneuver envelopes 32*g* may be generated through a computer simulation model. In one implementation, a system utilizes a seven degree-of-freedom (DOF) model to generate maneuver envelopes 32*g* for given quadrant elevations and launch speeds. In one example, the plurality of maneuver envelopes 32*g* may be loaded into the at least one non-transitory computer-readable storage medium 38 and executed by the at least one processor 40 based on the known quadrant elevation at which the launch assembly 56 is positioned and the launch velocity of the guided projectile 14. In another example, a single maneuver envelope 32*g* representing a particular launch condition may be loaded before launch of the guided projectile 14. For example, and not meant as a limitation, the maneuver envelope 32*g* may be loaded into the PGMA 10 before launch of the guided projectile 14.

After launch, the processor 40 executes the instructions stored on the storage medium 38 in order to refer to the associated maneuver envelope 32*g* for that quadrant elevation and launch speed at which the guided projectile 14 was launched. The guided projectile 14 utilizes various logic to predict the nominal impact point of the guided projectile 14 relative to the intended target 24. Then, canard logic or corrective maneuver logic uses the maneuver envelope 32*g* to determine the canard command to steer the guided projectile 14 in the range direction or cross-range direction. Stated otherwise, the canard logic moves the at least one canard 28*a*, 28*b*, in response to a signal from the at least one processor 40 provided by the maneuver envelope 32*g*.

The maneuver envelopes 32*g* may also be referred to as "maneuverability tables" or control maps or control effectiveness map(s). The maneuver envelopes 32*g* in this example are tables that provide the amount of ground maneuver per second at the maximum canard deflection. The maneuver envelope 32*g* specifies range and cross range translation on the ground that a one second maximum canard deflection (at roll=phi) at time T will produce. The maneuver envelope provides delta range (dR) and delta cross range (dXR) as a function of mission time (T) and canard roll angle, phi. Stated as an equation, the maneuver envelope is (dR, dXR)=Control_Map (T, phi). Wherein if the canard assembly is at roll angle=phi and has max deflection at time T it will cause the guided projectile 14 to change range by dR and cross range by dXR for each second.

The details and features of the control maps depend on the launch angle and speed of the guided projectile 14. The use of such control maps addresses the large variation of projectile dynamics and allows greater efficiency and control authority. Some exemplary maneuver envelopes 32*g* are detailed in FIG. 4A through FIG. 6C. The maneuver envelope examples show some of the features, variations, and complexities that need to be accounted for in order to optimally use the limited control authority of the guided projectile 14. Other features for different launch conditions are also represented by the maneuver envelopes.

Figure 4A:
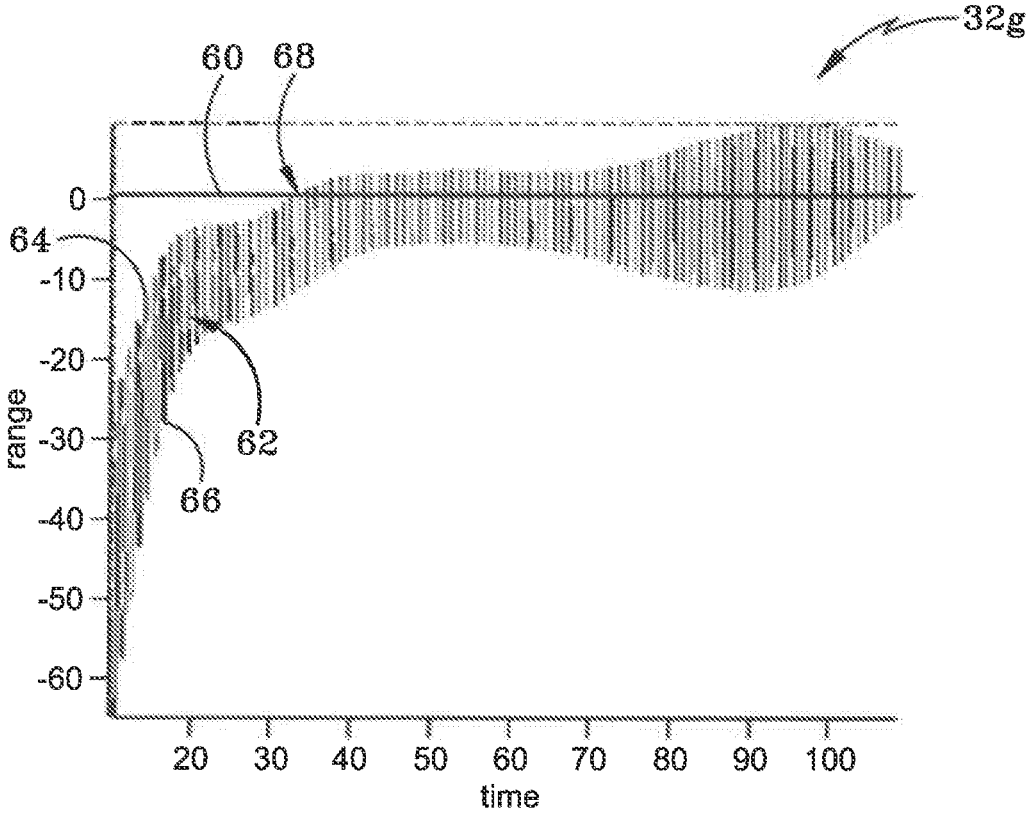
FIG. 4A is a chart of an exemplary maneuver envelope of range versus time.
Figure 4B:
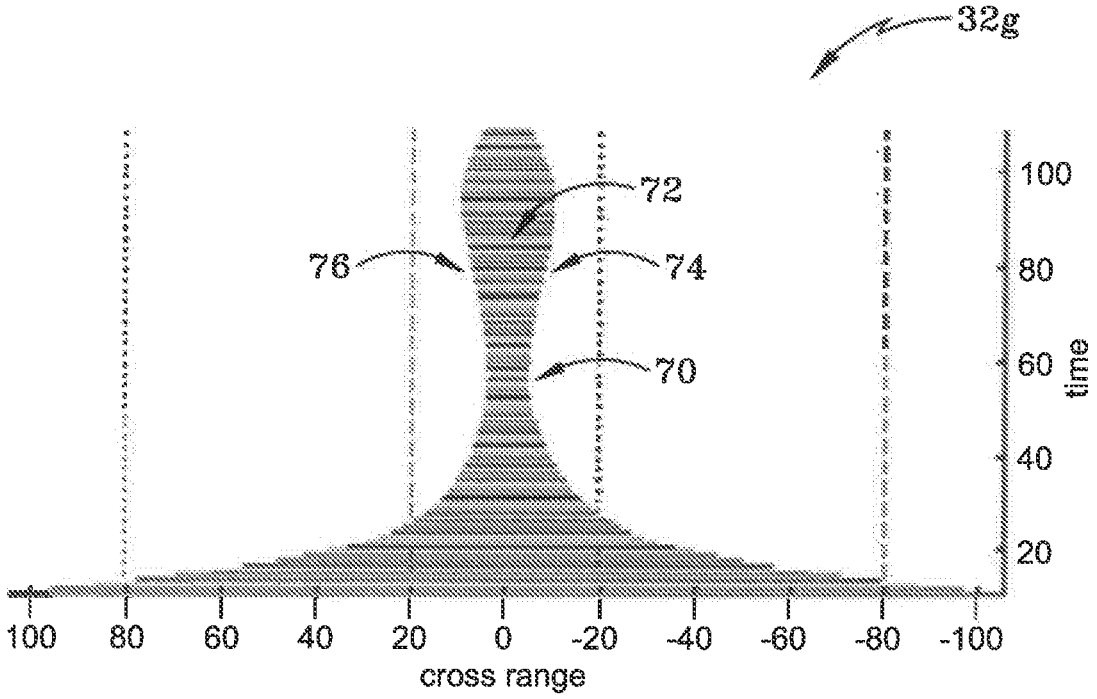
FIG. 4B is a chart of the exemplary maneuver envelope of FIG. 4A of cross-range versus time.

FIG. 4A and FIG. 4B depict range and cross range values from one maneuver envelope 32*g* from the plurality of maneuver envelopes 32*g*. FIG. 4A depicts an example control map 32*g* where the X-axis represents the range in meters and the Y-axis represents the time in seconds. Line 60 represents the no maneuver nominal guided projectile 14 range with canards set to zero deflection. The range maneuver authority 62 is a function of time. The range maneuver authority 62 includes a maximum 64 and a minimum 66 per second as a function of time. For example, at about twenty seconds, the maneuver authority range per second is from about minus twenty to about minus five for a maximum canard deflection command. Both the minimum and maximum of the maneuver authority range 62 are below the nominal range line 60, which means that any movement by the at least one canard 28*a*, 28*b*, will result in guiding or steering the guided projectile 14 in a manner that will shorten the distance of the guided projectile 14 from its predicted target impact. Stated otherwise, during the early portions of the flight, all movements of the at least one canard 28*a*, 28*b*, will shorten the range of the guided projectile 14 for this maneuver envelope 32*g*, which is dependent on quadrant elevation of the launch assembly 56 and launch speed.

It is only after a certain period of time that the range maximum 64 extends above and beyond the line 60 that the range of the guided projectile 14 can be extended. In this particular case, the period of time is about thirty-five seconds, shown at 68 in which the maximum 64 of the maneuver authority range 62 exceeds the nominal range line 60. It is to be understood that details of the control authority are described by the maneuver envelope 32*g*. The time in which the maximum 64 of the maneuver authority range 62 can increase range is shown generally after 68. Thus, with reference to the first maneuver envelope 32*g*, the guided projectile 14 would need to wait until after thirty-five seconds in order to deflect the at least one canard 28*a*, 28*b*, in a manner that would result in an increase in the range from the nominal range line 60. Stated otherwise, a deflection or movement of the at least one canard 28*a*, 28*b*, occurring before the control reversal time 68 will decrease the range of the guided projectile 14 and the same movement of the at least one canard 28*a*, 28*b*, occurring after time 68 will result in an increase in range.

FIG. 4B depicts a maneuver envelope 32*g* pertaining to the cross-range (i.e., meters or feet) maneuverability versus time (i.e., seconds). The cross-range maneuverability, according to the maneuver envelope 32*g*, is greatest early in flight. In one embodiments as shown in FIG. 4B near time equals zero or T=0, the roll canards 28*b* can maneuver the guided projectile 14 approximately one hundred meters per second either to the left or to the right of the target 24. As time in flight increases, the ability of the roll canards 28*b* to adjust the cross-range units decreases until the flight of the guided projectile 14 reaches its apogee 70 at about fifty seconds. Then, as the guided projectile 14 begins its downward trajectory, the roll canards 28*b* again increase in their ability to maneuver the guided projectile 14 within a cross-range maneuver authority 72. Stated otherwise, the cross-range maneuver authority 72 extends between a rightmost cross-range 74 and a leftmost cross-range 76 wherein the maneuver authority of the cross-range is at its lowest near the apogee 70. Furthermore, for the maneuver envelope 32*g*, the greatest maneuver authority range 72 of the cross-range occurs at periods or intervals of time that are before the apogee 70 in the early part of flight.

Figure 5A:
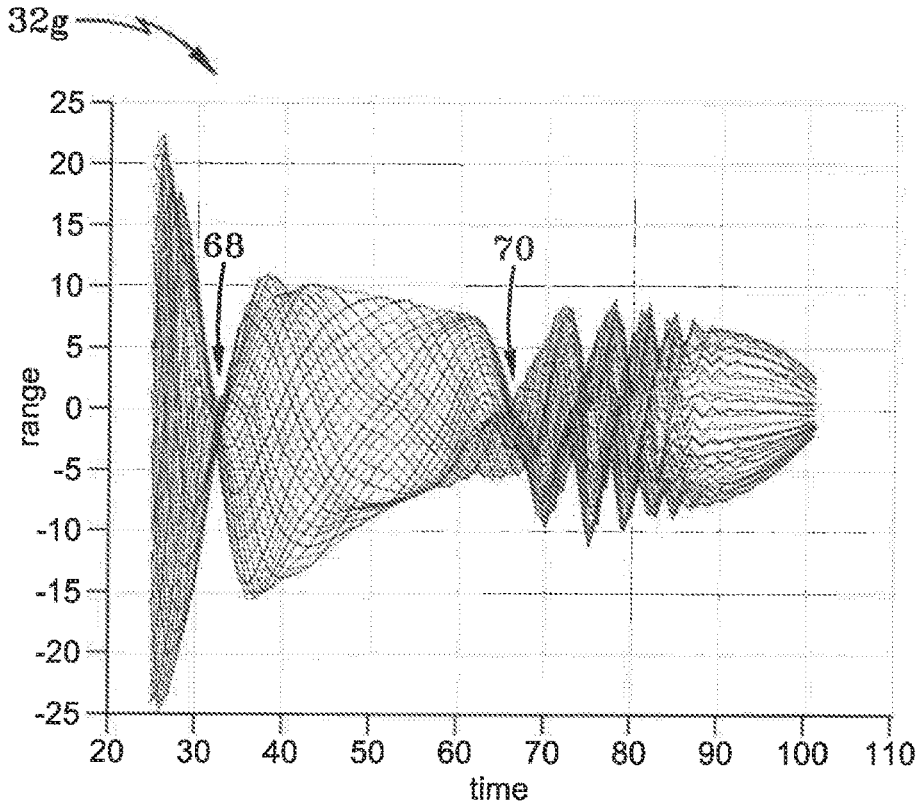
FIG. 5A is a chart of another exemplary maneuver envelope of range versus time.

FIG. 5A depicts another maneuver envelope 32*g* showing range per unit time (i.e., meters per second) versus time in seconds. The simulation model for this maneuver envelope 32*g* refers to a guided projectile 14 fired from launch assembly 56 at a quadrant elevation of 1200 mil. Notably, this is a high quadrant elevation wherein high quadrant elevations refer to those quadrant elevations above 800 mil (45°). As a result of the high quadrant elevation, the maneuver envelope has features that must be considered in order to generate a canard command.

With continued reference to FIG. 5A, the high quadrant elevation of 1200 mil results in a control reversal at a time of thirty-one seconds, denoted as 68 in FIG. 5A. The control reversal time 68 occurring at approximately thirty-one seconds is indicative of the fact that a similar movement of the lift canard 28*a* will affect the direction in which the guided projectile 14 moves towards or away from the target 24, dependent on whether the movement occurs before or after the control reversal time 68. Furthermore, in some instances, the control reversal time 68 is congruent with or after the apogee 70 and, in other situations, such as identified by maneuver envelope 32*g*, the control reversal time may be before the apogee 70 of the flight of the guided projectile 14.

Figure 5B:
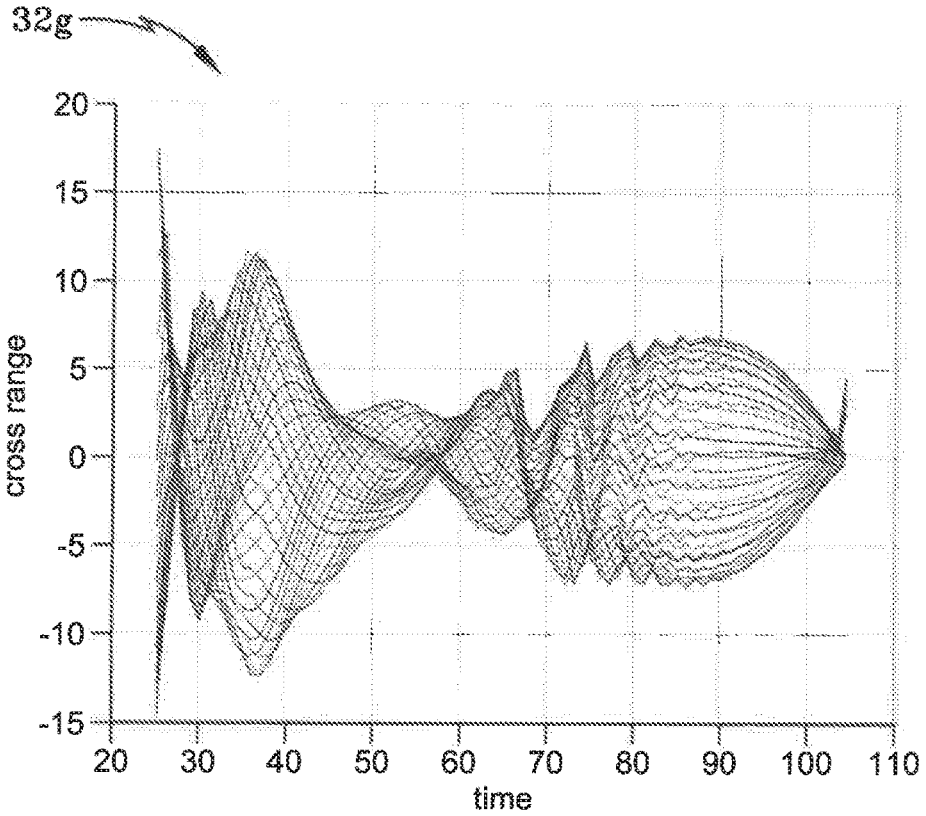
FIG. 5B is a chart of the exemplary maneuver envelope of FIG. 5A of cross-range versus time.

FIG. 5B depicts the cross-range maneuverability versus time function of the maneuver envelope 32*g*. Similar to the range function identified in FIG. 5A, the cross-range maneuver per unit time versus time function of the maneuver envelope 32*g* indicates that the maneuverability is greatest early in the flight (i.e., where the time equals twenty-five seconds or less). Then, as time progresses, the cross-range maneuverability fluctuates depending upon the time in flight of the guided projectile 14. It should be noted that the lines shown in FIG. 5A and FIG. 5B show the maneuvers for different roll angles of the precision guidance munition assembly 10 where each line represents a specific roll angle. This shows that the required roll angle to obtain a maneuver in a specific direction (e.g., range, cross-range or a combination of range and cross-range) changes as a function of time. The maneuver envelope 32*g* allows the correct roll angle to be selected given the direction of the desired maneuver.

Figure 6A:
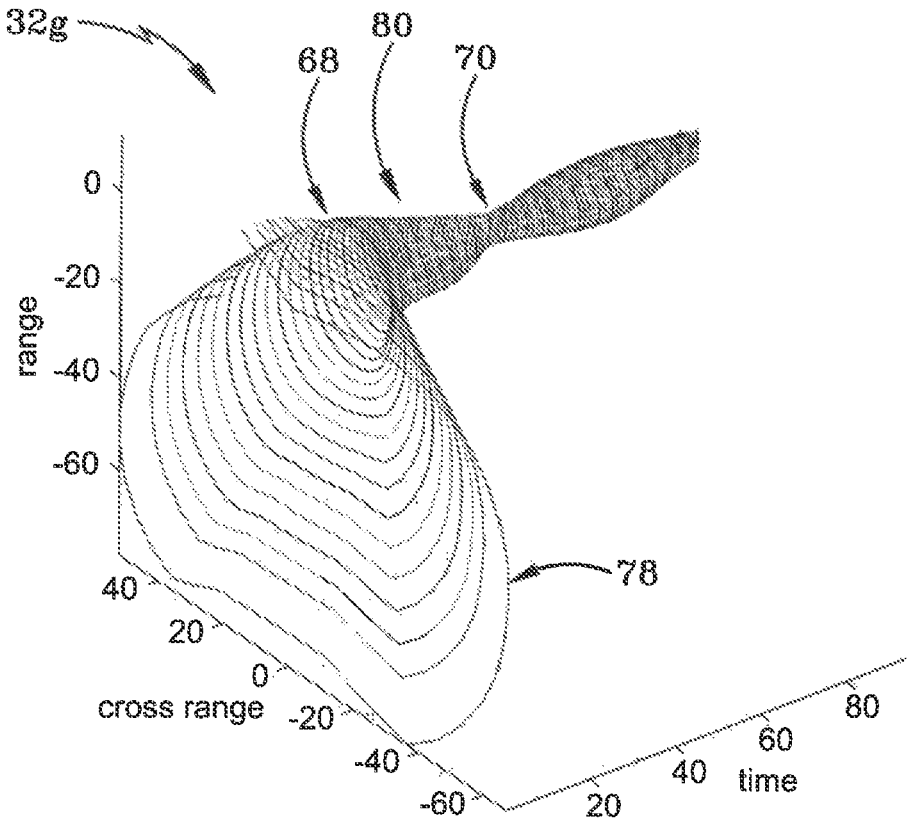
FIG. 6A is a chart of another exemplary maneuver envelope depicting maneuver authority represented by command rings for range and cross-range versus time which represents ground motion versus time as well as the precision guidance munition assembly PGMA roll angle depicted by location on the command rings.

FIG. 6A depicts a maneuver envelope 32*g* with a plurality of command rings 78 that are defined by a three-dimensional combination of range maneuverability and cross-range maneuverability as a function of time. Each ring 78 defines the potential movement in both range and cross-range. Once the miss distance of the projectile is obtained, a roll angle can be chosen which will lessen the miss distance. The roll angle is determined by the position on the command rings 78 that defines the direction of the required maneuver in range, cross-range, or a combination of range and cross-range. The distance of a point on the ring from the origin, (the 0,0 location on the axis) represents the maneuver distance on the ground per unit command time. The location of the point on the ring is related to the direction of the maneuver on the ground relative to the target 24. The total maneuver authority is defined by the full set of command rings 80 and can be computed by summing over all rings. The three-dimensional maneuver envelope 32*g* indicates that at an early flight time, such as time equals twenty seconds or less, the cross-range maneuverability is greater than what it is later in time and may vary from about minus forty units to about forty units. Stated otherwise, the cross-range maneuver authority 72 generally decreases with slight fluctuations or blips of increases as time in flight increases.

Further, early on in the flight, for this high quadrant elevation, the range maneuverability will generally be less than zero which refers to the fact that the guided movement of the at least one canard 28*a*, 28*b* on the precision guidance munition assembly 10 will result in a range correction maneuver that will always shorten the impact distance of the guided projectile 14 from the target 24 if control is attempted early in flight. It is only after a specific time 68, which in a particular example, occurs around thirty seconds, that movements of the at least one canard 28*a*, 28*b*, will result in a positive directional movement of the guided projectile 14 relative to the target 24 on the ground.

Figure 6B:
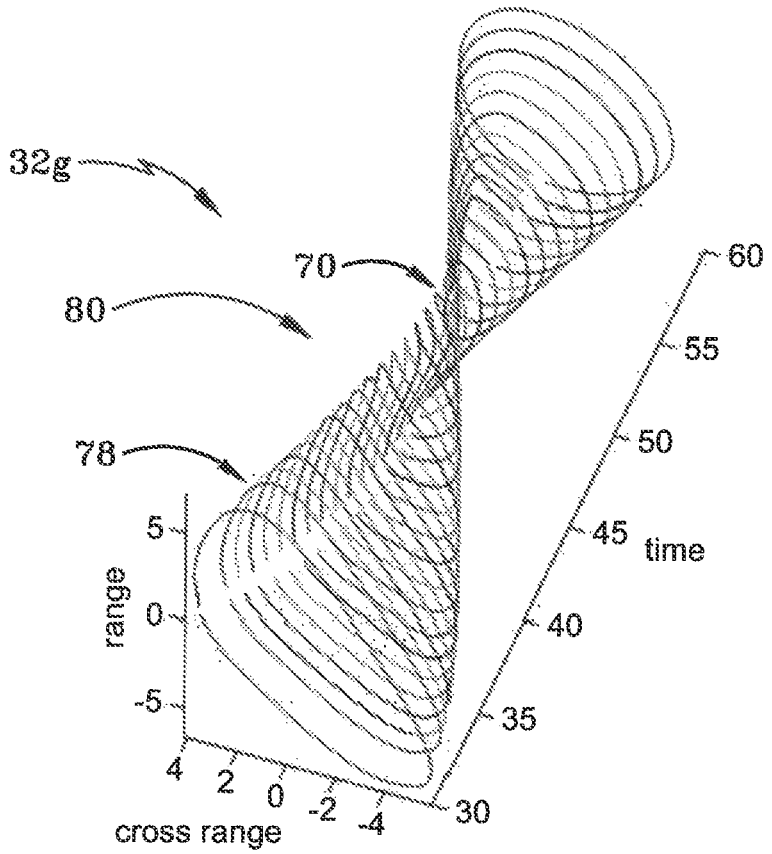
FIG. 6B is a selected portion of the chart from FIG. 6A highlighting the maneuver authority across the apogee of the guided projectile.
Figure 6C:
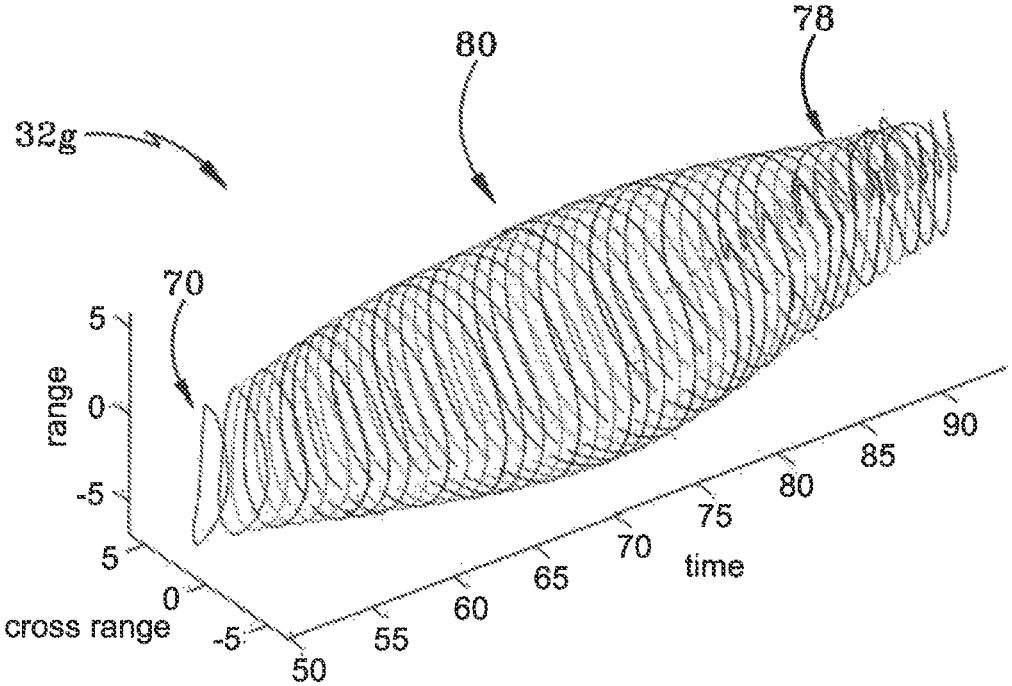
FIG. 6C is a selected portion of the chart from FIG. 6A highlighting the maneuver authority after the apogee of the guided projectile.

The apogee 70 of the guided projectile 14 impacts the maneuver envelope 32*g* by reducing the control authority which occurs around fifty seconds as indicated at 70 and is best shown in FIG. 6B. At the apogee 70, there is low dynamic pressure acting on the guided projectile 14. Stated otherwise, maneuverability and control is low at the apogee 70. Thus, the shape of the plot of the maneuver envelope 32*g* narrows to a throat at the apogee 70. FIG. 6C shows a portion of the maneuver envelope 32*g* subsequent to the apogee 70. After the apogee 70, the command rings get larger as the projectile speed increases. At 80, where time equals seventy seconds, the command rings begin to shrink because the projectile is approaching the target and thus the time for making maneuver commands is getting small.

Figure 7:
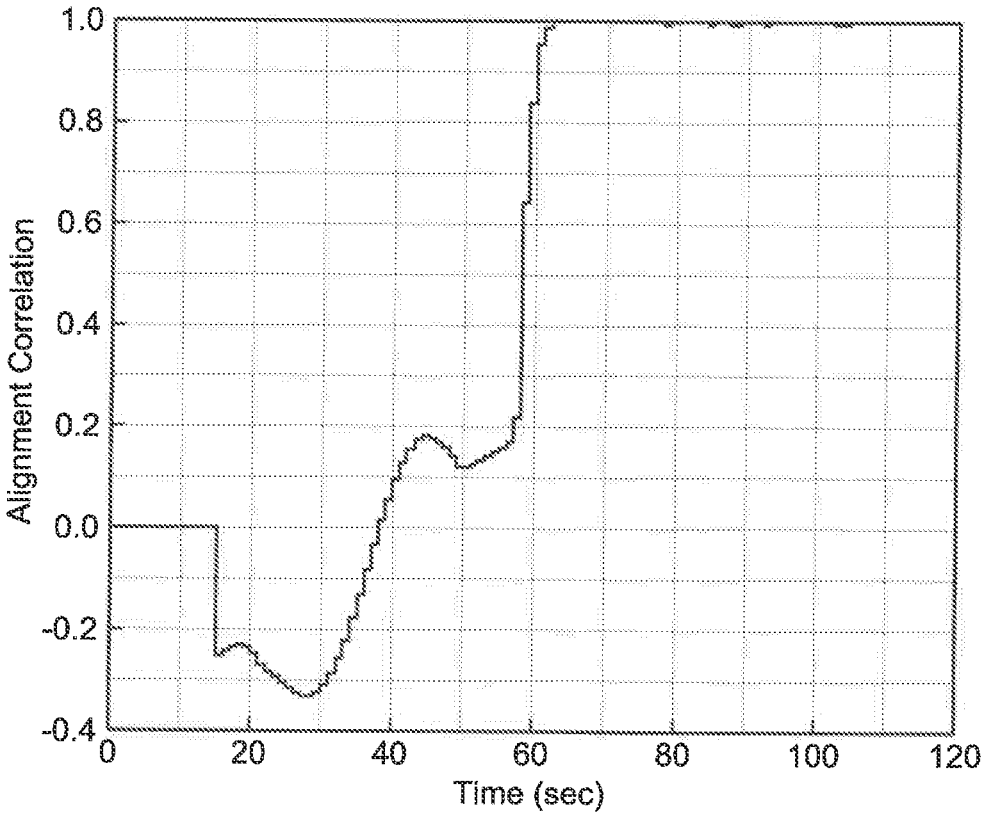
FIG. 7 is a chart depicting an exemplary match ratio versus time based on a dot product utilized by the system to optimize when to make a corrective maneuver.

FIG. 7 is a plot of an optimization function that evaluates the ability of the guided projectile 14 to maneuver in a specific direction on the ground as a function of time in the flight. This defines the alignment correlation value, which may also be referred to as a match ratio versus time. This alignment correlation is a function of time and direction. Thus, for example, the alignment correlation could refer to a maneuver to extend range and shift cross range to the left when viewed from behind the guided projectile 14. A value close to one of the alignment correlation value, which, in one example, may be anything greater than approximately 0.85, indicates that a maneuver is possible while a low value of the alignment correlation value, which, in one example, may be anything less than approximately 0.85, indicates a limited ability to maneuver. For example, when the alignment correlation value is less than 0.85, a range increase maneuver might not be possible early in flight.

Specifically, FIG. 7 is a dot product of normalized vectors that the precision guidance munition assembly 10 utilizes in order to optimize when to make corrections and the PGMA 10 will not attempt to maneuver in a direction when the alignment correlation value is low. Such cases may occur at apogee or times that control reversals occur. The use of the dot product optimizes the time when the at least one canard 28*a*, 28*b*, moves to effectuate the corrective maneuver. This optimization can consist of preventing or inhibiting the maneuver if the correlation is low and waiting until the correlation becomes large enough (greater than 0.85). By doing so, control actions that waste control energy by attempting to steer in a direction that has a low correlation are prevented.

The dot product evaluates whether the command that results in the movement of the at least one canard 28*a*, 28*b*, to effectuate the maneuver is effective. For example, if the cross range is correct (i.e., on target) and the range is determined to be incorrect (i.e., off target), then the dot product will ensure that the range maneuver occurs at a point where range control can be effective. The dot product enables the guided projectile 14 to ensure that a maneuver in one direction (such as cross-range) will not come at the expense of maneuverability in the other direction (such as range). The system is encoded with threshold logic to indicate that if the match ratio of the dot product falls below a certain threshold, a corrective maneuver may not occur. For example, as indicated in FIG. 7, around when time equals fifty-nine, the dot product of the match ratio falls to zero (off the page). The dot product threshold is typically around 0.85, but whenever the dot product value falls below 0.85, the logic in the precision guidance munition assembly 10 determines that a corrective maneuver should not be performed at that time.

In accordance with one aspect of the present disclosure, the dot product representation enables the system to generate the optimal control commands which select a command that takes into account the maneuverability dead zones of the guided projectile 14. The maneuverability dead zones are regions with low alignment correlation or low maneuverability. A command generator picks the command that has the highest alignment correlation. In one particular example for illustrative purposes, the alignment correlation must be greater than 0.85 for the guided projectile 14 to engage canard 28*a*, 28*b*, deflections. If the correlation is less than 0.85, the guided projectile 14 is unable to maneuver in its desired direction without sacrificing some other maneuver authority or causing undesired effects in the orthogonal direction. The control logic associated with generating the optimal command for the control map avoids canard 28*a*, 28*b*, deflections during the maneuver dead zones.

In accordance with one aspect of the present disclosure, the precision guidance munition assembly 10 optimally uses the control or maneuver authority that the guided projectile 14 has based on the predetermined maneuver envelope 32*g*. This is important because a guided projectile 14 is typically limited in its maneuver authority, unlike a missile that can be actively guided and steered when powered from its self-carried propulsion device. The system and device of the precision guidance munition assembly 10 enables an improved correction of range and cross-range of the guided projectile 14 after being fired from launch assembly 56. The improvement is a result of more efficient use of the limited control authority.

Various inventive concepts may be embodied as one or more methods, of which an example has been provided. The acts performed as part of the method may be ordered in any suitable way. Accordingly, embodiments may be constructed in which acts are performed in an order different than illustrated, which may include performing some acts simultaneously, even though shown as sequential acts in illustrative embodiments.

Figure 8:
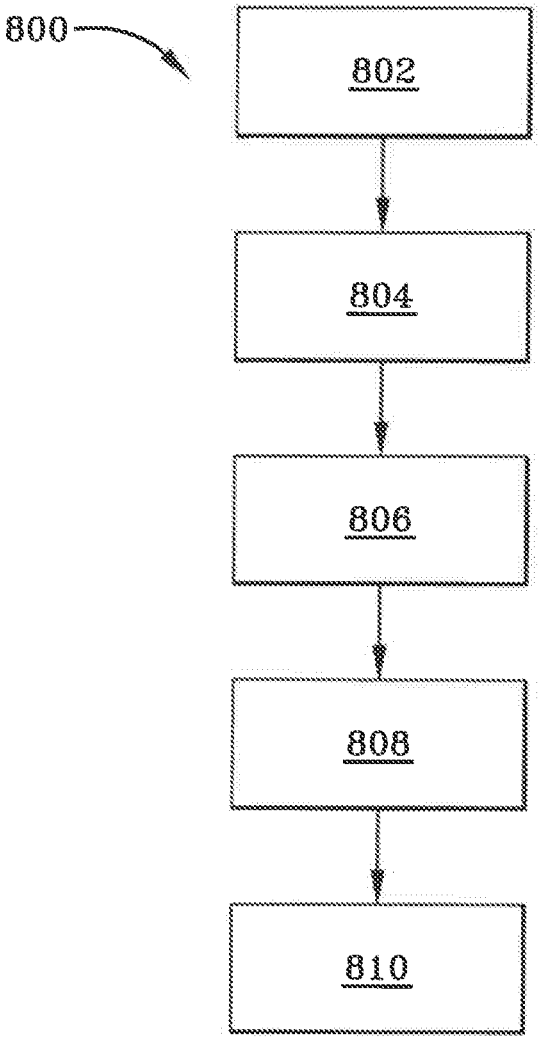
FIG. 8 is a flow chart of one method or process of the present disclosure.

For example, FIG. 8 depicts one exemplary method in accordance with the present disclosure. The method of FIG. 8 is shown generally at 800. Method 800 may include selecting a maneuver envelope 32*g* that describes a control authority of the guided projectile 14, which is shown generally at 802. The method 800 may include predicting an impact point of the guided projectile 14 relative to a target 24, which is shown generally at 804. The method 800 may include determining a miss distance error based on the predicted impact point relative to the target 24, which is shown generally at 806. The method 800 may include determining a maneuver command based on the maneuver envelope 32*g*, which is shown generally at 808. The method 800 may include optimally applying the maneuver command to move the at least one canard 28*a*, 28*b*, on the canard assembly 28 at an optimal time based, at least in part, on the maneuver envelope 32*g*, which is shown generally at 810.

Further this exemplary method or other exemplary methods may additionally include steps or processes that may include wherein the selecting the maneuver envelope 32*g* that describes the control authority of the guided projectile 14 is accomplished by selecting the maneuver envelope 32*g* from a plurality of maneuver envelopes 32*g* stored in the at least one non-transitory computer-readable storage medium 38. This exemplary method or other exemplary methods may additionally include steps or processes that may include wherein the selecting the maneuver envelope 32*g* that describes the control authority of the guided projectile 14 is accomplished by uploading a predetermined maneuver envelope 32*g* to the at least one non-transitory computer-readable storage medium 38 prior to firing the guided projectile 14.

This exemplary method or other exemplary methods may additionally include steps or processes that include optimally applying the maneuver command to move the at least one canard 28*a*, 28*b*, on the canard assembly 28 at an optimal time based, at least in part, on the maneuver envelope 32*g* and the method further comprises producing a dot product for a match ratio versus time, and evaluating whether the maneuver command that results in the movement of the at least one canard 28*a*, 28*b*, to effectuate steering the guided projectile 14 is effective. This exemplary method or other exemplary methods additionally include steps or processes that include preventing movement of the at least one canard 28*a*, 28*b*, when threshold logic determines that the match ratio of the dot product falls below a certain threshold. This exemplary method or other exemplary methods additionally include steps or processes that include timing, via a timer carried by the precision guidance munition assembly 14, a time in flight, and wherein optimally applying the maneuver command to move the at least one canard 28*a*, 28*b*, on the canard assembly 28 at an optimal time based, at least in part, on the maneuver envelope 32*g* is accomplished by indicating, via a plurality of command rings at different time intervals, range maneuverability and cross-range maneuverability of the guided projectile 14 at a respective time interval.

While various inventive embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the inventive embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the inventive teachings is/are used. Those skilled in the art will recognize, or be able to ascertain using no more than routine experimentation, many equivalents to the specific inventive embodiments described herein. It is, therefore, to be understood that the foregoing embodiments are presented by way of example only and that, within the scope of the appended claims and equivalents thereto, inventive embodiments may be practiced otherwise than as specifically described and claimed. Inventive embodiments of the present disclosure are directed to each individual feature, system, article, material, munition assembly, and/or method described herein. In addition, any combination of two or more such features, systems, articles, materials, munition assemblies, and/or methods, if such features, systems, articles, materials, munition assemblies, and/or methods are not mutually inconsistent, is included within the inventive scope of the present disclosure.

The above-described embodiments can be implemented in any of numerous ways. For example, embodiments of technology disclosed herein may be implemented using hardware, software, or a combination thereof. When implemented in software, the software code or instructions can be executed on any suitable processor or collection of processors, whether provided in a single computer or distributed among multiple computers. Furthermore, the instructions or software code can be stored in at least one non-transitory computer-readable storage medium 18.

Also, a computer utilized to execute the software code or instructions via its processors may have one or more input and output devices. These devices can be used, among other things, to present a user interface. Examples of output devices that can be used to provide a user interface include printers or display screens for visual presentation of output and speakers or other sound generating devices for audible presentation of output. Examples of input devices that can be used for a user interface include keyboards, and pointing devices, such as mice, touch pads, and digitizing tablets. As another example, a computer may receive input information through speech recognition or in other audible format.

Such computers or smartphones may be interconnected by one or more networks in any suitable form, including a local area network or a wide area network, such as an enterprise network, and intelligent network (IN) or the Internet. Such networks may be based on any suitable technology and may operate according to any suitable protocol and may include wireless networks, wired networks or fiber optic networks.

The various methods or processes outlined herein may be coded as software/instructions that is executable on one or more processors that employ any one of a variety of operating systems or platforms. Additionally, such software may be written using any of a number of suitable programming languages and/or programming or scripting tools, and also may be compiled as executable machine language code or intermediate code that is executed on a framework or virtual machine.

In this respect, various inventive concepts may be embodied as a computer-readable storage medium (or multiple computer-readable storage media) (e.g., a computer memory, one or more floppy discs, compact discs, optical discs, magnetic tapes, flash memories, USB flash drives, SD cards, circuit configurations in Field Programmable Gate Arrays or other semiconductor devices, or other non-transitory medium or tangible computer storage medium) encoded with one or more programs that, when executed on one or more computers or other processors, perform methods that implement the various embodiments of the disclosure discussed above. The computer-readable medium or media can be transportable, such that the program or programs stored thereon can be loaded onto one or more different computers or other processors to implement various aspects of the present disclosure as discussed above. The term loaded as used herein refer to any type of uploading via software or loading via any computer readable storage medium.

The terms "program" or "software" or "instructions" are used herein in a generic sense to refer to any type of computer code or set of computer-executable instructions that can be employed to program a computer or other processor to implement various aspects of embodiments as discussed above. Additionally, it should be appreciated that according to one aspect, one or more computer programs that when executed perform methods of the present disclosure need not reside on a single computer or processor, but may be distributed in a modular fashion amongst a number of different computers or processors to implement various aspects of the present disclosure.

Computer-executable instructions may be in many forms, such as program modules, executed by one or more computers or other devices. Generally, program modules include routines, programs, objects, components, data structures, etc. that perform particular tasks or implement particular abstract data types. Typically the functionality of the program modules may be combined or distributed as desired in various embodiments.

Also, data structures may be stored in computer-readable media in any suitable form. For simplicity of illustration, data structures may be shown to have fields that are related through location in the data structure. Such relationships may likewise be achieved by assigning storage for the fields with locations in a computer-readable medium that convey relationship between the fields. However, any suitable mechanism may be used to establish a relationship between information in fields of a data structure, including through the use of pointers, tags or other mechanisms that establish relationship between data elements.

All definitions, as defined and used herein, should be understood to control over dictionary definitions, definitions in documents incorporated by reference, and/or ordinary meanings of the defined terms.

"Guided projectile" or guided projectile 14 refers to any launched projectile such as rockets, mortars, missiles, cannon shells, shells, bullets and the like that are configured to have in-flight guidance.

"Launch Assembly" or launch assembly 56, as used herein, refers to rifle or rifled barrels, machine gun barrels, shotgun barrels, howitzer barrels, cannon barrels, naval gun barrels, mortar tubes, rocket launcher tubes, grenade launcher tubes, pistol barrels, revolver barrels, chokes for any of the aforementioned barrels, and tubes for similar weapons systems, or any other launching device that imparts a spin to a munition round or other round launched therefrom.

"Precision guided munition assembly," as used herein, should be understood to be a precision guidance kit, precision guidance system, a precision guidance kit system, or other name used for a guided projectile.

"Quadrant elevation", as used herein, refers to the angle between the horizontal plane and the axis of the bore when the weapon is laid. The quadrant elevation is the algebraic sum of the elevation, angle of site, and complementary angle of site.

In some embodiments, the munition body 12 is a rocket that employs a precision guidance munition assembly 10 that is coupled to the rocket and thus becomes a guided projectile 14.

"Logic", as used herein, includes but is not limited to hardware, firmware, software and/or combinations of each to perform a function(s) or an action(s), and/or to cause a function or action from another logic, method, and/or system. For example, based on a desired application or needs, logic may include a software controlled microprocessor, discrete logic like a processor (e.g., microprocessor), an application specific integrated circuit (ASIC), a programmed logic device, a memory device containing instructions, an electric device having a memory, or the like. Logic may include one or more gates, combinations of gates, or other circuit components. Logic may also be fully embodied as software. Where multiple logics are described, it may be possible to incorporate the multiple logics into one physical logic. Similarly, where a single logic is described, it may be possible to distribute that single logic between multiple physical logics.

Furthermore, the logic(s) presented herein for accomplishing various methods of this system may be directed towards improvements in existing computer-centric or internet-centric technology that may not have previous analog versions. The logic(s) may provide specific functionality directly related to structure that addresses and resolves some problems identified herein. The logic(s) may also provide significantly more advantages to solve these problems by providing an exemplary inventive concept as specific logic structure and concordant functionality of the method and system. Furthermore, the logic(s) may also provide specific computer implemented rules that improve on existing technological processes. The logic(s) provided herein extends well beyond merely gathering data, analyzing the information, and displaying the results. Further, portions or all of the present disclosure may rely on underlying equations that are derived from the specific arrangement of the equipment or components as recited herein. Thus, portions of the present disclosure as it relates to the specific arrangement of the components are not directed to abstract ideas. Furthermore, the present disclosure and the appended claims present teachings that involve more than performance of well-understood, routine, and conventional activities previously known to the industry. In some of the method or process of the present disclosure, which may incorporate some aspects of natural phenomenon, the process or method steps are additional features that are new and useful.

The indefinite articles "a" and "an," as used herein in the specification and in the claims, unless clearly indicated to the contrary, should be understood to mean "at least one." The phrase "and/or," as used herein in the specification and in the claims (if at all), should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc. As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of." "Consisting essentially of," when used in the claims, shall have its ordinary meaning as used in the field of patent law.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively, as set forth in the United States Patent Office Manual of Patent Examining Procedures.

An embodiment is an implementation or example of the present disclosure. Reference in the specification to "an embodiment," "one embodiment," "some embodiments," "one particular embodiment," "an exemplary embodiment," or "other embodiments," or the like, means that a particular feature, structure, or characteristic described in connection with the embodiments is included in at least some embodiments, but not necessarily all embodiments, of the invention. The various appearances "an embodiment," "one embodiment," "some embodiments," "one particular embodiment," "an exemplary embodiment," or "other embodiments," or the like, are not necessarily all referring to the same embodiments.

If this specification states a component, feature, structure, or characteristic "may", "might", or "could" be included, that particular component, feature, structure, or characteristic is not required to be included. If the specification or claim refers to "a" or "an" element, that does not mean there is only one of the element. If the specification or claims refer to "an additional" element, that does not preclude there being more than one of the additional element.

Additionally, the method of performing the present disclosure may occur in a sequence different than those described herein. Accordingly, no sequence of the method should be read as a limitation unless explicitly stated. It is recognizable that performing some of the steps of the method in a different order could achieve a similar result.

In the foregoing description, certain terms have been used for brevity, clearness, and understanding. No unnecessary limitations are to be implied therefrom beyond the requirement of the prior art because such terms are used for descriptive purposes and are intended to be broadly construed.

Moreover, the description and illustration of various embodiments of the disclosure are examples and the disclosure is not limited to the exact details shown or described.

The invention claimed is:

1. A precision guidance munition assembly for a guided projectile, comprising:

a canard assembly comprising at least one canard coupled to the precision guidance munition assembly, wherein the at least one canard is moveable; and at least one non-transitory computer-readable storage medium carried by the precision guidance munition assembly having a set of instructions encoded thereon that when executed by at least one processor operates to aid in guidance, navigation and control of the guided projectile, wherein the set of instructions comprise:

select a maneuver envelope that describes a control authority of the guided projectile, wherein the maneuver envelope comprises a plurality of command rings identifying an amount of ground maneuver per second as a function of time, based, at least in part, on a roll angle and a maximum canard deflection;

predict an impact point of the guided projectile relative to a target;

determine a miss distance based on the predicted impact point relative to the target;

determine a maneuver command based on the maneuver envelope; and apply the maneuver command to move the at least one canard at an optimal time based, at least in part, on the maneuver envelope; and wherein when the maneuver command is applied during a first time interval the range increases and when the maneuver command is applied during a second time interval the range decreases.

2. The precision guidance munition assembly of claim 1, wherein the selected maneuver envelope is based, at least in part, on a launch velocity and a quadrant elevation of the guided projectile.

3. The precision guidance munition assembly of claim 1, wherein the selected maneuver envelope is predetermined and loaded to the at least one non-transitory computer-readable storage medium prior to firing the guided projectile.

4. The precision guidance munition assembly of claim 1, further comprising:

a plurality of maneuver envelopes stored in the at least one non-transitory computer-readable storage medium, wherein the selected maneuver envelope is selected from the plurality of maneuver envelopes.

5. The precision guidance munition assembly of claim 1, wherein the set of instructions further comprise:

select a roll angle from a time interval of the maneuver envelope to reduce the miss distance.

6. The precision guidance munition assembly of claim 1, further comprising:

a timer in operative communication with the at least one processor; and a plurality of command rings of the maneuver envelope at different time intervals of a flight of the guided projectile that indicate a range maneuverability and a cross-range maneuverability of the guided projectile within each of the different time intervals and roll angles of the precision guidance munition assembly.

7. The precision guidance munition assembly of claim 6, wherein the plurality of command rings are predetermined and loaded to the at least one non-transitory computer-readable storage medium prior to firing the guided projectile.

8. The precision guidance munition assembly of claim 6, wherein the plurality of command rings are determined through a modeling function accounting for the launch velocity and the quadrant elevation of the guided projectile.

9. The precision guidance munition assembly of claim 6, further comprising:

canard logic that moves the at least one canard in response to a signal from the at least one processor associated with the maneuver envelope.

10. The precision guidance munition assembly of claim 1, wherein the set of instructions further comprise:

produce a dot product for a match ratio versus time; and evaluate whether the selected maneuver command is effective.

11. The precision guidance munition assembly of claim 10, wherein the selected maneuver command is effective if the match ratio versus time is greater than or equal to 0.85.

12. The precision guidance munition assembly of claim 10, wherein the set of instructions further comprise:

apply the selected maneuver command to move the at least one canard based, at least in part, on the match ratio versus time.

13. The precision guidance munition assembly of claim 10, wherein the set of instructions further comprise:

prevent the selected maneuver command from being applied at a first time based, at least in part, on the match ratio versus time.

14. The precision guidance munition assembly of claim 13, wherein the set of instructions further comprise:

apply the selected maneuver command to move the at least one canard on the canard assembly at a second time that is different than the first time based, at least in part, on the match ratio versus time.

15. The precision guidance munition assembly of claim 10, wherein the dot product includes normalized vectors.

16. The precision guidance munition assembly of claim of claim 10, wherein the instructions further comprise:

prevent the selected maneuver command from being applied during a maneuverability dead zone.

17. A computer program product including one or more non-transitory machine-readable mediums having instructions encoded thereon that, when executed by one or more processors, result in a plurality of operations for guiding a projectile to a target, the operations comprising:

selecting a maneuver envelope that provides a control authority of the projectile, wherein the maneuver envelope comprises a plurality of command rings identifying an amount of ground maneuver per second as a function of time, based, at least in part, on a roll angle and a maximum canard deflection;

predicting an impact point of the projectile relative to the target;

determining a miss distance based on the predicted impact point relative to the target;

determining a maneuver command based on the maneuver envelope;

applying the maneuver command to move at least one canard of the projectile at an optimal time based, at least in part, on the maneuver envelope; and wherein when the maneuver command is applied during a first time interval the range increases and when the maneuver command is applied during a second time interval the range decreases.

* * * * *